United States Patent [19]

Shiratori

[11] 4,423,873

[45] Jan. 3, 1984

[54] GOLF CLUB PUTTER ARRANGEMENT

[76] Inventor: Yukio Shiratori, 1806 Clear Creek Dr., Fullerton, Calif. 92633

[21] Appl. No.: 129,339

[22] Filed: Mar. 11, 1980

Related U.S. Application Data

[63] Continuation-in-part of Ser. No. 915,618, Jun. 15, 1978, Pat. No. 4,212,467.

[51] Int. Cl.[3] ..... A63B 69/36; A63B 53/10

[52] U.S. Cl. ..... 273/163 A; 273/80 R; 273/183 D; 273/DIG. 14

[58] Field of Search ..... 124/87; 273/77 R, 80 R, 273/80 B, 80.9, 162 R, 162 B, 163 R, 163 A, 164, 183 D, 183 E, 186 R, 192, 193 R, 194 R, DIG. 14; 33/174 F, 263, 265, 276, 277, 289, 297, 334, 389

[56] References Cited

U.S. PATENT DOCUMENTS

| | | | |
|---|---|---|---|
| 2,236,414 | 3/1941 | Reach | 273/80 A X |
| 2,420,252 | 5/1947 | Land | 33/276 X |
| 2,919,491 | 1/1960 | Darrell et al. | 33/334 |
| 3,182,401 | 5/1965 | Stevens | 273/162 B X |
| 3,186,092 | 6/1965 | Bertas | 33/277 |
| 3,242,582 | 3/1966 | Garrett | 273/162 B X |
| 3,806,133 | 4/1974 | Cork | 273/80 R X |

FOREIGN PATENT DOCUMENTS

| | | | |
|---|---|---|---|
| 30050 | of 1912 | United Kingdom | 273/80 B |

OTHER PUBLICATIONS

"Popular Mechanics"; Jul. 1959; p. 124.

*Primary Examiner*—Richard J. Apley
*Attorney, Agent, or Firm*—Finkelstein, McGuire & Thut

[57] ABSTRACT

A golf club arrangement provided with indicia means to aid in the reading of the break of a green. The shaft of the golf club has a slot extending in the longitudinal direction which is either left open or filled with a distortion free transparent filler having parallel planar surfaces on opposite sides of the shaft. A square tubular shaft allows a maximization of the width of the slot to aid in the use of the indicia means. A cross hair intersects the indicia means at right angles to facilitate the positioning of the club. When the green is observed through the slot and compared to the indicia means, both the break in the green due to the natural lie of the grass and the overall slope of the green may be determined.

24 Claims, 30 Drawing Figures

16
24
28
26

28'
24'
26'
16'

24
40

22
12
10
26
20
2
2
16
18
14

16
12
34
26
30
32

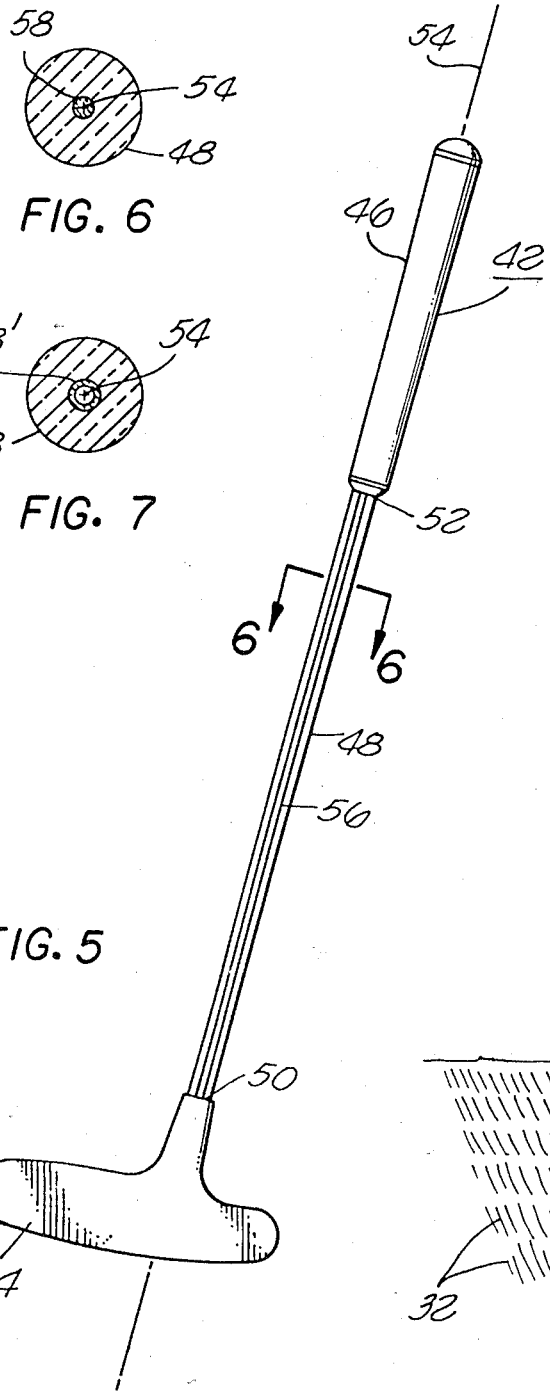
FIG. 5
FIG. 6
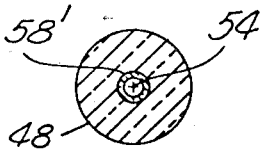
FIG. 7
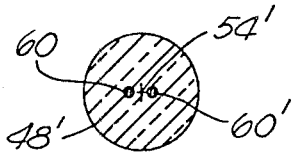
FIG. 8
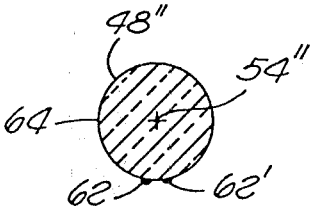
FIG. 9
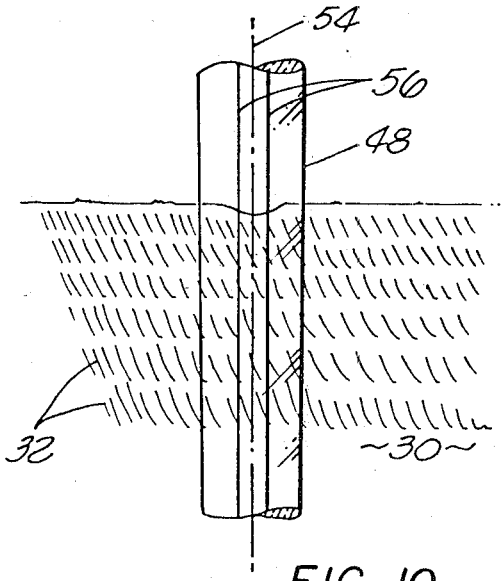
FIG. 10

FIG. 16
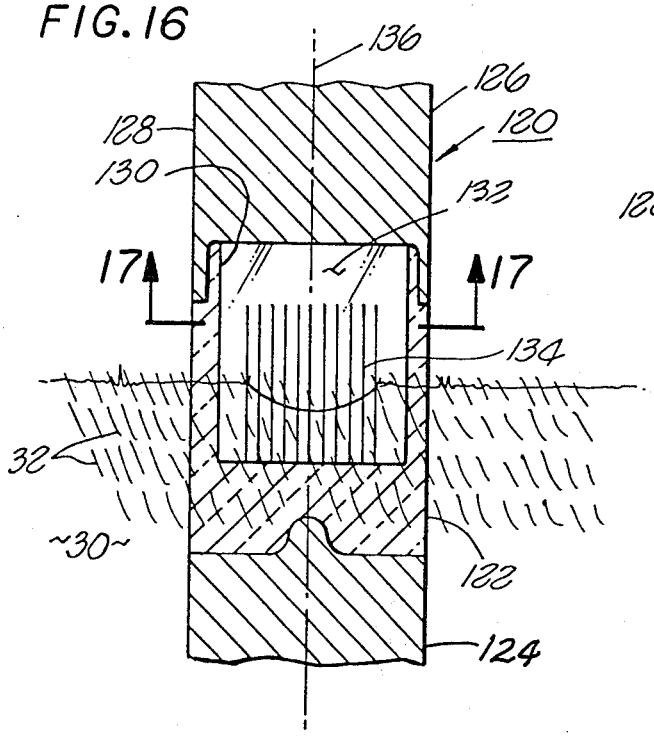
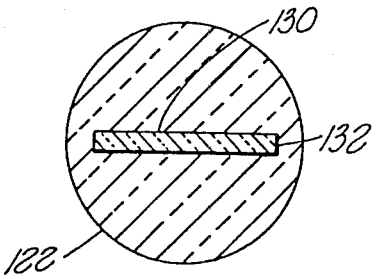
FIG. 17
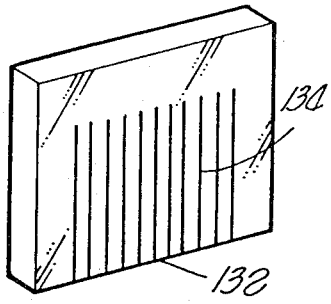
FIG. 18
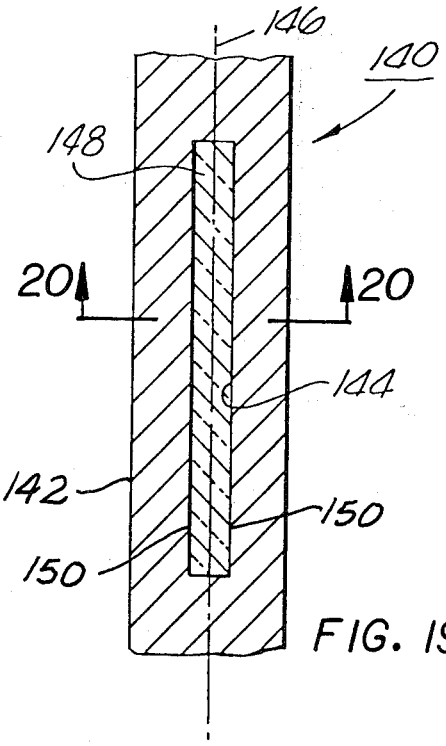
FIG. 19
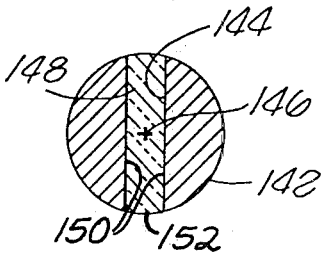
FIG. 20

GOLF CLUB PUTTER ARRANGEMENT

CONTINUATION-IN-PART

This application is a continuation-in-part of my copending patent application Ser. No. 915,618 filed June 15, 1978, now U.S. Pat. No. 4,212,467 issued July 15, 1980 and the teaching and technology thereof are incorporated by reference herein.

BACKGROUND OF THE INVENTION

1. Field of the Invention

This invention relates to the golf club art and more particularly to an improved golf club arrangement for aiding in reading the "break" in a green.

2. Background of the Invention

In the game of golf, one important aspect, of course, is that portion of the game comprised of putting. During the putting portion of the golf game the golf ball rests upon the green which also contains the cup or hole. In most golf courses the green is a well gardened and tended area and, it has been found, the grass of the green has a natural lie. That is, the grass does not grow completely vertical but tends to lean, in general, in one particular direction. Thus, a golf ball putted on the green will tend to break or be deflected from its course in the direction of the lean of the grass. Also, the plane of the green often is not horizontal to the earth. Thus, a golf ball may also tend to break from its course due to gravity. The ability to be able to read the break in the green becomes important in the ability of the golfer to be able to judge accurately the path that the golf ball will take after being struck toward the cup as well as aiding in determining the force with which the golfer must strike the ball.

Reading of the green, has in the past, not heretofore been generally successfully done. Many golfers hold a golf club, such as a putter, vertical in an attempt to sight the green along the edge of the golf club in an attempt to determine the break of the green. Other golfers examine the green closely, for example, by sighting along the green from the ball toward the cup in an attempt to read the green. Such activities have not heretofore provided as accurate a reading of the green as desired in order to be able to give the golfers information upon which to base both the direction and force with which the golf ball must be putted.

Accordingly, there has long been a need in golfing for a golf club which incorporates means for enabling the golfer to judge more accurately the particular break of the green between the position of the golf ball and the cup.

SUMMARY OF THE INVENTION

Accordingly, it is an object of the present invention to provide an improved golf club.

It is an object of the present invention to provide a golf club incorporating means for aiding in reading the green.

It is another object of the present invention to provide a golf club, generally a golf club putter, which incorporates means for allowing the golfer to visually determine the break of the green between the golf ball and the cup.

The above, and other objects, are achieved, according to a preferred embodiment of the present invention, by providing a golf club, such as a golf club putter, which incorporates a club head having a face for striking the golf ball. The golf club has an elongated longitudinally extending shaft connected to the head and the remote end of the shaft is provided with a grip means. Both the grip means and the club head may be of any desired configuration.

As described in the above mentioned copending patent application, the shaft means comprises a transparent portion located intermediate the club head and the grip means. The transparent portion may extend all or substantially all of the longitudinal distance between the grip means and the club head or only a portion thereof. The transparent portion is provided with indicia means which extend a predetermined longitudinal distance along the transparent portion. The indicia means may appear to the golfer to be a line or a plurality of lines which are less transparent that the remainder of the transparent portion. The indicia means may be on the external surface of the transparent portion or positioned interior. Thus, the indicia means may comprise a straight line extending along the peripheral surface of the transparent portion in the longitudinal direction. Alternatively, the indicia means may comprise a thin wire interior the transparent portion, for example, lying along the longitudinal axis of the shaft. Thus, where a single indicia means is provided it is preferably positioned in a plane containing the longitudinal axis of the shaft.

The indicia means may also be provided by a plurality of lines on the peripheral surface of the shaft which lines are parallel to the longitudinal axis.

In another embodiment of the present invention the indicia means may be provided by a tube or rod positioned coaxially with the longitudinal axis of the shaft and the tube or rod may have any desired diameter to provide the indicia. Because of defraction occurring at the interface between the tube or rod and the remainder of the transparent portion, the edges of the tube or rod will appear to be opaque giving the visual appearance of a pair of lines.

In yet another embodiment of the present invention the indicia means is provided by a plurality of parallel appearing lines, parallel to the longitudinal axis of the shaft and which lines may be on the peripheral surface or internal the transparent portion.

In yet another embodiment of the present invention a slot may be cut into the shaft having a predetermined longitudinal length and a preferably comparatively narrow predetermined width. The slot may be left open or filled, if desired, with a transparent material. The edges of the slot may provide the indicia means.

In utilizing the golf club of the present invention on a level green, the golfer holds the golf club so that the longitudinal axis of the shaft is vertical and looks at the green through the transparent portion. The indicia means provided on the transparent portion are thus vertical and the angle that, in general, the grass of the green makes with the indicia means indicates the lie of the grass. The greater the angle, it has been found, the greater will be the break and thus the golfer may determine both the direction and estimate the force with which to strike the ball in order to drive it to the cup taking into account both the break and the amount of break inherent in the green.

However, according to the principals of the present invention, a slot having a predetermined longitudinal length and a predetermined width preferably as wide as possible within the strength requirements of the shaft is fabricated in the shaft. The slot is left open thereby presenting no optical distortion to the viewer of the green. The sides of the slot provide indicia means. Alternatively, an indicia means may be located along the surface of the shaft or internal the exterior surface of the shaft.

The shaft may have either an arcuate, for example, circular, or a polyhedron, for example, square, cross section. The advantage of the shaft with a square cross section is that, for a given shaft width, the shaft having the square cross section is stronger than the shaft having a circular cross section. Thus, if a given strength must be maintained, the shaft with the square cross section allows a wider slot to be fabricated than does the shaft with the circular cross section. The wider slot facilitates viewing of objects on the other side of the shaft.

In yet another embodiment of the present invention, the slot is as wide as possible and is filled with a transparent material having polished planar front and rear surfaces which are parallel to each other to thereby minimize the optical distortion through the transparent filler. The sides of the slot provide indicia means. Alternatively, an indicia means may be located along the surface of the transparent filler or internal the transparent filler.

In another embodiment of the present invention, the indicia means is provided with a cross hair at a convenient height.

Thus, in utilizing the embodiment of the golf club of the present invention having a cross hair, the golfer, as a first step, holds the club by the grip means with the head resting on the green. The longitudinal axis of the shaft is made vertical to the plane of the green by sighting through the shaft and making the cross hair level with the green. The indicia means is, thus, vertical to the plane of the green and therefore is positioned to determine only the effect of the natural lie of the grass on a putted ball and not to introduce any gravitational considerations into the calculation of the ball trajectory. After the break in the green due to the grass is determined, the golfer, as a second step, may position the club vertical with the earth by holding the club as a pendulum. The break in the green due to the slope of the plane of the green may then be determined by comparing the plane of the green with the indicia means. Thus, both the grass break and gravitational break of the green may be determined utilizing the present invention.

Alternatively, both the grass break and gravitational break may be determined in one step by suspending the golf club as a pendulum and then comparing the angle of the grass and the slope of the green to the indicia means.

BRIEF DESCRIPTION OF THE DRAWINGS

The above and other embodiments of the present invention may be more fully understood from the following detailed description taken together with the accompanying drawings wherein similar reference characters refer to similar elements throughout and in which:

FIG. 5 illustrates another embodiment of the present invention;

FIG. 6 is a sectional view along the line 6—6 of FIG. 5;

FIGS. 7, 8 and 9 each illustrate other embodiments of the present invention;

FIG. 10 illustrates utilization of the embodiment shown in FIG. 6 of the present invention;

FIG. 16 illustrates another embodiment of the present invention;

FIG. 17 is a sectional view along the line 17—17 of FIG. 16;

FIG. 18 illustrates an indicia bearing means useful in the practice of the embodiment shown in FIG. 16;

FIG 19 illustrates another embodiment of the present invention;

FIG. 20 is a sectional view along the line 20—20 of FIG. 19;

DESCRIPTION OF THE PREFERRED EMBODIMENTS

Figures 1, 2, 3, 4:
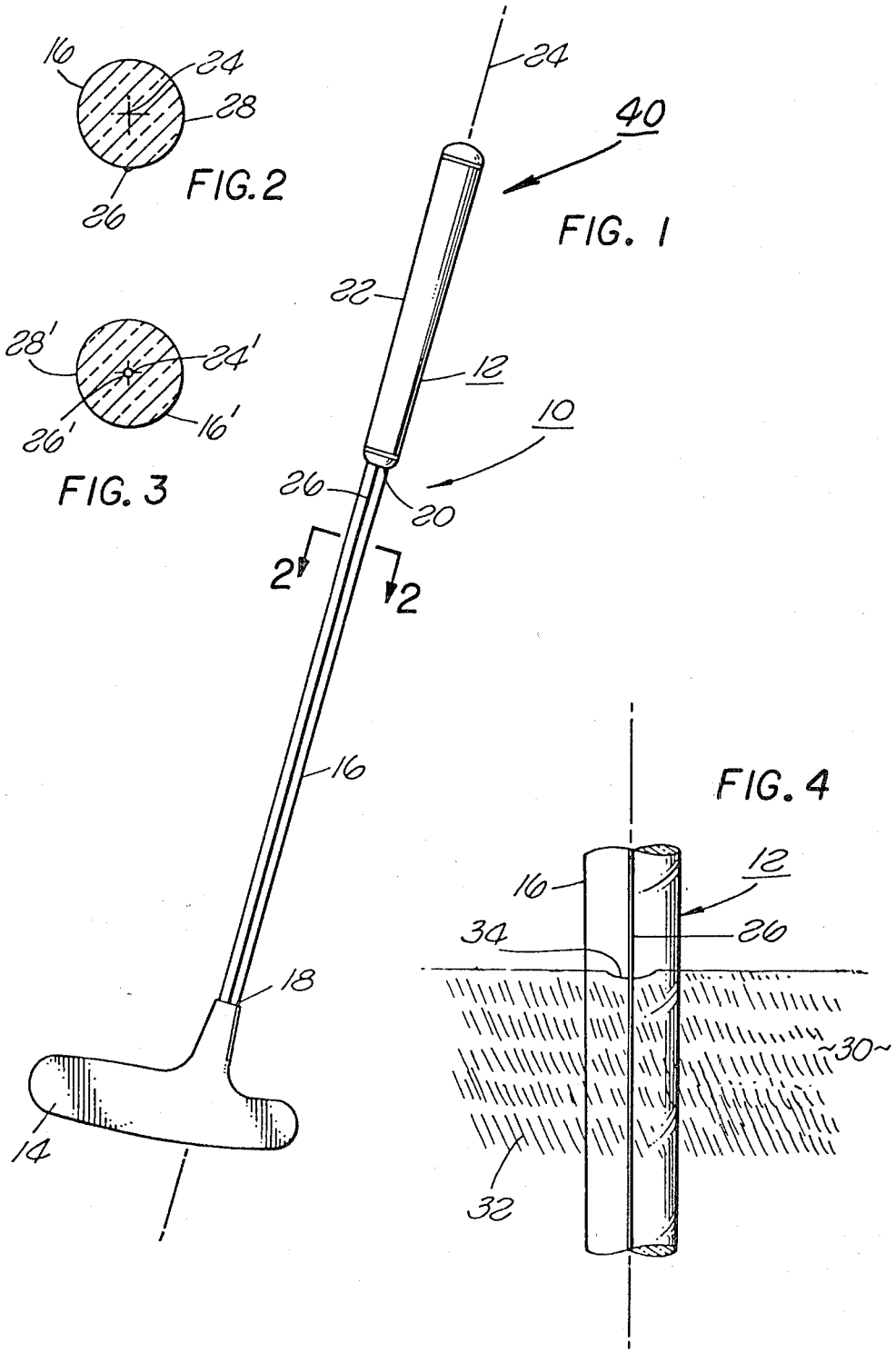
FIG. 1 illustrates a golf club according to the principles of the present invention.
FIG. 2 is a sectional view along the line 2—2 of FIG. 1.
FIG. 3 illustrates another embodiment of the present invention.
FIG. 4 illustrates utilization of the embodiment shown in FIG. 1.

My U.S. Pat. No. 4,212,467 describes various aspects of my invention. As described therein, and referring now to the drawing, there is illustrated, in FIG. 1, an embodiment, generally designated 10 of the golf club generally designated 12. In the embodiment 10 the golf club is depicted as a putter. However, it will be appreciated, the invention is not limited to incorporation in a putter but may be incorporated in any desired golf club.

The golf club 12 is provided with a club head 14, an elongated longitudinally extending shaft means 16 having a first end 18 coupled to the club head 14 and a second end 20 coupled to the grip means 22. The club head 14 and the grip means 22 may be of any desired configuration.

The elongated longitudinally extending shaft means 16 has a longitudinal axis 24. In the embodiment 10 shown in FIG. 1 the shaft means 16 is fabricated from a transparent material such as plastic or the like and is provided with indicia means 26 extending between the grip means 22 and the club head 24. The indicia means 26 is less transparent than the remainder of the shaft means 16 and, for example, may be opaque. Preferably, the indicia means 26 appears as a thin line lying in a plane containing the longitudinal axis 24 of the shaft means 16. The indicia means 26, may, as illustrated in FIG. 2, comprise a thin line on the external peripheral surface 28 of the shaft means 16. Alternatively, as illustrated in FIG. 3, the indicia means 26' as shown thereon may comprise a thin wire embedded internal the transparent shaft means 16' and along the longitudinal axis 24' thereof.

Utilization of the golf club 12 is illustrated in FIG. 4. As shown in FIG. 4 the golf club 12 is held so that the shaft means 16 is vertical to the green and the golfer views the green, generally designated 30, therethrough. The grass 32 of the green has, as illustrated in FIG. 4, a natural growth whereby it leans toward the left as shown on FIG. 4. By viewing the grass 32 through the transparent shaft means 16 the angle that the grass 32 makes with the indicia means 26 may be observed. Thus, as shown in FIG. 4 the green 30 has a natural lie to the left. Thus, a golf ball putted toward the cup 34 on the green 30 will have a natural tendency to break toward the left since the resistance of the grass 32 is less in the direction of the lie of the grass 32. The greater the angle that the grass 32 makes with the indicia means 26 the greater will be the tendency of the golf ball putted toward the cup 34 to break or move from a straight line toward the left and therefore there is a greater resistence to the ball traveling toward the right. Therefore, the golfer may estimate from the visual appearance of the grass 32 of the green 30 through the transparent portion of the shaft means 16 both the direction of the break as well as the amount of the break and therefore may estimate both the direction and force needed to propel the golf ball from a given location toward the cup 34.

FIG. 5 illustrates another embodiment generally designated 40. As shown in FIG. 5 the golf club 42 which may be generally similar to the golf club 12 depicted in FIG. 1, is provided with a club head 44 and a grip means 46. An elongated longitudinally extending shaft means 48 is provided having a first end 50 coupled to the club head 44 and a second end 52 coupled to the grip means 46. The shaft means 48 has a longitudinal axis 54 and, in the embodiment 40, the shaft means 48 is transparent between the first end 50 and second end 52. In the embodiment 40 the indicia means 56 appears as a pair of parallel lines. This appearance of the pair of parallel lines may be provided, for example, as illustrated in FIG. 6 by providing a rod 50 coaxially aligned with the longitudinal axis 54 internal the transparent shaft means 48. The rod 58 may be opaque, or transparent, as desired, and has a predetermined diameter which, for example, may be greater than the thin wire 26' shown in FIG. 3. The defraction of light at the interface between the rod 58 and the transparent shaft means 48 gives the appearance of the two parallel lines comprising the indicia means 56 illustrated in FIG. 5 when the rod 58 is transparent.

Alternatively, as illustrated in FIG. 7, the rod 58 may be replaced by a tube 58' coaxially aligned with the longitudinal axis 54 of the shaft means 48 and, once again, the defraction of light at the interface between the external peripheral surface of the tube 58' and the transparent shaft means 48 provides the appearance of the two parallel lines defining the indicia means 56. The tube 58' may have any desired wall thickness and may be opaque or transparent, as desired. When the tube 58' is opaque, of course, the space between the two parallel appearing lines defining indicia means 56 is also opaque.

The provision of two parallel lines as the indicia means 56 may also be provided as illustrated in FIGS. 8 and 9. As shown in FIG. 8 the shaft means 48' is provided with two thin wires 60 and 60' internal thereof lying in a plane containing the longitudinal axis 54' of the shaft means 48'. The two thin wires 60 and 60' may be similar to the wire 26' shown in FIG. 3.

FIG. 9 illustrates another arrangement for providing the two parallel appearing indicia means 56 shown in FIG. 5. As shown in FIG. 9, the shaft means 48'' may be provided with a pair of lines 62 and 62' spaced a preselected distance apart on the external surface 64 of the shaft means 48''. Each of the lines 62 and 62' may be similar to the line 26 illustrated in FIG. 2 and each lies in a plane containing the longitudinal axis 54'' of the shaft means 48''.

FIG. 10 is an illustration, generally similar to FIG. 4 illustrating utilization of the embodiments shown in FIG. 5, 6, 7, 8 and 9. As can be seen from FIG. 10, the green 30 may be viewed through the transparent shaft, for example, shaft 48 with the longitudinal axis 54 thereof in a vertical orientation. The angle that the grass 32 makes with the indicia means 56 comprising the two parallel appearing lines provides additional accuracy in measuring both the angle and direction of the natural lie of the grass 32, as described above.

Figure 12:
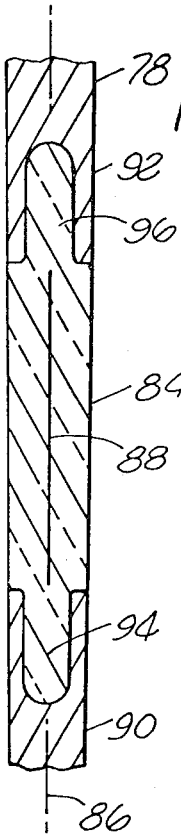
FIG. 12 illustrates a method of attaching a transparent portion into the shaft of a golf club according to the principles of the present invention.
Figure 11:
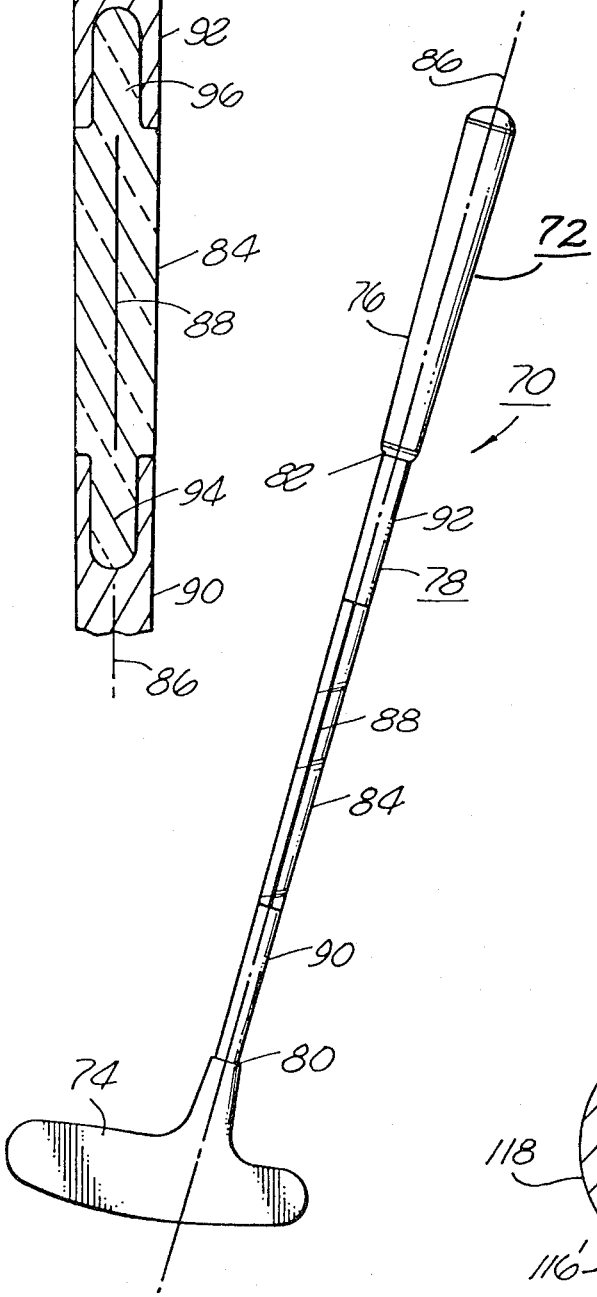
FIG. 11 illustrates another embodiment of the present invention.

Referring now to FIG. 11 there is illustrated another embodiment generally designated 70. The embodiment 70 comprises a golf club 72 having a club head 74, which may be similar to the club heads 14 and 44 described above and a grip means 76 which may be similar to the grip means 22 and 46 described above. In the embodiment 70 there is provided a shaft means 78 having a first end 80 coupled to the club head 74 and a second end 82 coupled to the grip means 76. In the embodiment 70, however, the shaft means 78 is provided with a transparent portion 84 intermediate the club head 74 and grip means 76 and the transparent portion 84 does not extend from the first end 80 to the second end 82. Preferably, the transparent portion 84 extends in the longitudinal direction defined by the longitudinal axis 86 of the shaft means 78 approximately one to two feet, though greater or lesser lengths of the transparent portion 84 may be provided as desired. The transparent portion 84 has an indicia means 88 thereon and it may be similar to any of the indicia means illustrated in FIGS. 1 through 10 above. The transparent portion 84 may, if desired, be fabricated from the clear plastic and coupled to opaque solid portions 90 and 92 of the shaft means 78. FIG. 12 is a sectional view of the shaft means 78 illustrating a preferred arrangement for coupling the transparent portion 84 to the solid opaque portions 90 and 92 of the shaft means 78. As illustrated in FIG. 12 the transparent portion 84 is provided with protruding members 94 and 96 at opposite longitudinal ends thereof which are received in corresponding sockets of the portions 90 and 92 respectively. They may be bonded in place or otherwise securely attached thereto as desired.

Figure 13:
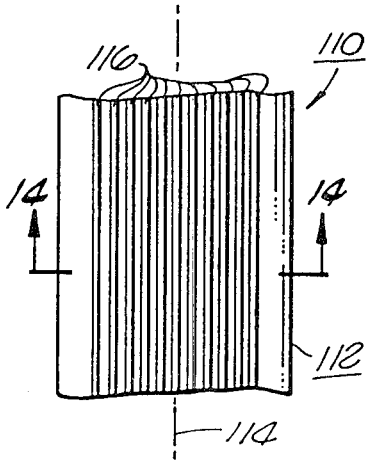
FIG. 13 illustrates another embodiment of the present invention.

FIG. 13 illustrates another embodiment generally designated 110 of a golf club. FIG. 13 illustrates a section of the transparent portion 112 of such a golf club, which, for example, may be incorporated in structure as illustrated in FIG. 1 or FIG. 11 as desired. The transparent portion 112 forms part of the shaft of the golf club and has a longitudinal axis 114. The indicia means 116, in the embodiment 110 is comprised of a plurality of parallel lines extending parallel to the longitudinal axis 114 and lying in a plane containing the longitudinal axis 114.

Figure 14:
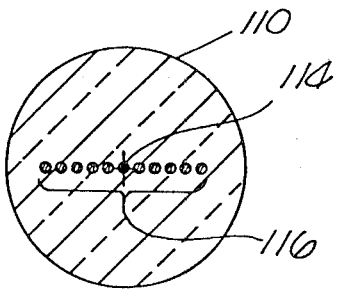
FIG. 14 is a sectional view along the line 14—14 of FIG. 13.

FIG. 14 is a sectional view through the embodiment 110 and illustrates the indicia means 116 comprised of a plurality of thin wires such as the thin wire 26' illustrated in FIG. 3 embedded in the transparent portion 112 and all lying in a plane containing the longitudinal axis 114.

Figure 15:
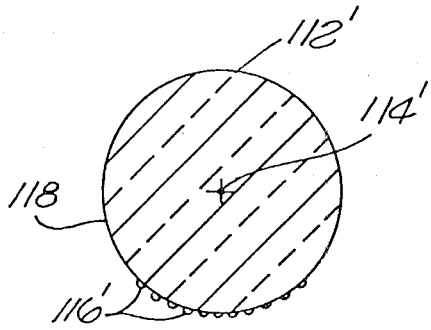
FIG. 15 illustrates another embodiment of the present invention.

Alternatively, the indicia means 116 may be provided by a plurality of lines 116', as shown in FIG. 15, lying on the external surface 118 of a transparent portion 112' in a manner similar to that shown for the indicia means 26 in FIG. 2 and 62 and 62' shown in FIG. 9. Each of the indicia means 116' lies in a plane containing the longitudinal axis 114' of the transparent portion 112'.

FIG. 16 illustrates yet another embodiment generally designated 120 in which a transparent portion 122 may be incorporated in the shaft of a golf club such as that illustrated in FIG. 11 wherein the transparent portion 122 only extends a portion of the distance between two opaque portions 124 and 126 of the shaft means 128. In the embodiment illustrated in FIG. 16 the transparent portion 122 is provided with walls 129 defining a slot 130 into which an indicia member 132 is inserted. The indicia member 132 has the indicia means 134 thereon which, for example, may be one or more parallel lines extending in the direction of the longitudinal axis 136 of shaft means 128. The transparent portion 122 is coupled to the opaque portions 124 and 126 by bonding or any other desired means.

FIG. 17 is a sectional view along the line 17—17 of FIG. 16 and illustrates how the indicia member 132 fits into slot 130 of the transparent portion 122. FIG. 18 illustrates the indicia member 132 having the indicia means 134 thereon. The indicia member 1332 may be cast in place if the transparent portion 122 is cast. Alternatively, indicia member 132 may be inserted into slot 130 provided in the transparent portion 122.

FIGS. 19 and 20 illustrate yet another embodiment, generally designated 140, in which a golf club shaft means 142 is provided with walls 144 defining a slot 145 extending therethrough for a predetermined longitudinal length along the longitudinal axis 146. Slot 145 may be filled with a transparent filler 148. Alternatively, slot 145 may be left open. Walls 144 of slot 145 provide the indicia means 150 when utilized as described above. Alternatively, one or more indicia means may be provided, either internal the transparent filler 148 or on the peripheral surface 152 of the transparent filler 148 in a manner as described above.

Figure 21:
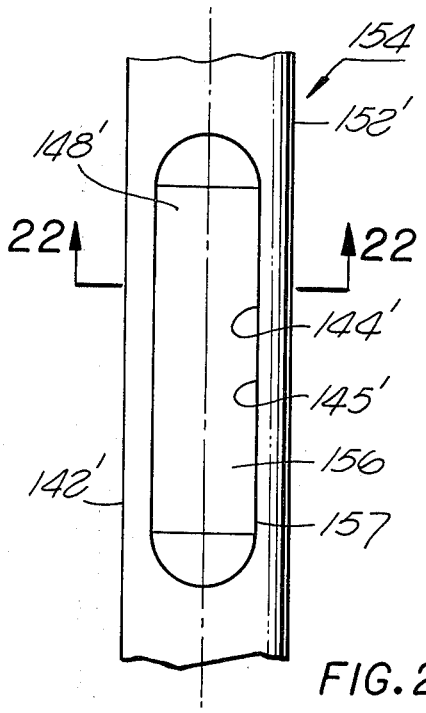
FIG. 21 illusttrates another embodiment of the present invention.
Figure 22:
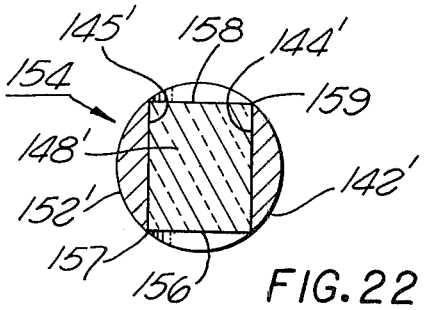
FIG. 22 is a sectional view along the line 22—22 of FIG. 21.

With the above in mind, the improvement of the present invention is illustrated in FIGS. 21 and 22 showing an embodiment of the present invention generally designated 154. Shaft means 142' has the same diameter as shaft means 142 of FIG. 19. Slot 145°, defined by walls 144', however, has a much wider predetermined transverse width than slot 145 of FIG. 19. The greater width of slot 145' in comparison to slot 145 of FIG. 19 improves the ability of the golfer to discern objects on the other side of shaft means 142'.

Slot 145' may contain a transparent member 148'. Distortion through transparent member 148' is minimized by providing front planar surface 156 on at least a portion of transparent member 148' adjacent the front intersection 157 of walls 144' with peripheral surface 152' and a rear planar surface 158 (FIG. 22), parallel and in alignment with front planar surface 156. Thus, light reflected from the image on the other side of shaft means 142' travels in parallel lines from the image, through rear planar surface 158, transparent filler 148', and front planar surface 156, to the eye of the golfer. Planar surfaces 156 and 158 thus further improve the ability of a golfer to discern objects on the other side of shaft means 142' in comparison to the cylindrical surfaces of embodiment 140 shown in FIGS. 19 and 20. Shaft means 142' has peripheral surface 152'. Slot 145' is filled with transparent member 148' to the front intersection 157 of walls 144' with peripheral surface 152' and to the rear intersection 159 of walls 144' with peripheral surface 152'. Transparent member 148' has front planar surfaces 156 and rear planar surface 158 parallel and aligned with each other at opposite ends of slot 145'.

Figure 23:
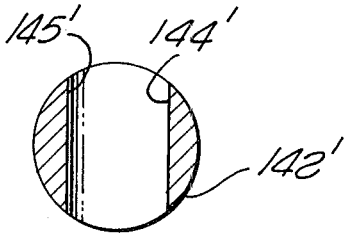
FIG. 23 is a sectional view of another embodiment of the present invention.

Alternatively, slot 145' may be left empty as illustrated in FIG. 23.

Figure 24:
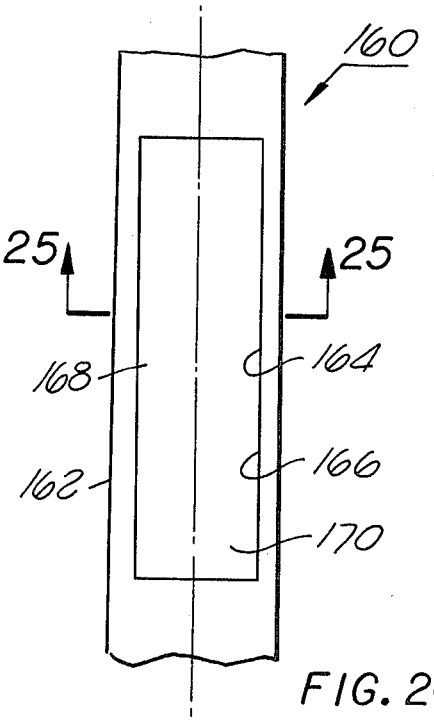
FIG. 24 illustrates another embodiment of the present invention.
Figure 25:
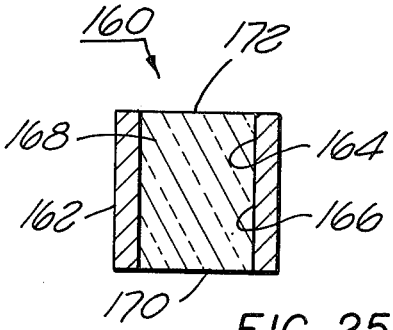
FIG. 25 is a sectional view along the line 25—25 of FIG. 24.

FIGS. 24 and 25 illustrate another embodiment, generally designated 160, of the present invention, having a shaft means 162 with a square cross section and thus the shaft may comprise a right angular equilateral right regular prism. The width of shaft means 162 is substantially identical to the diameter of shaft means 142' of embodiment 154. By fabricating shaft means 162 with a square cross section, slot 164, defined by walls 166, may be constructed wider than slot 145' of embodiment 154 illustrated in FIG. 21, while retaining the overall strength of shaft means 142'. Thus, slot 164 provides an enhanced view of objects on the other side of shaft means 162.

It will be appreciated that shaft means 162 of embodiment 160 may be fabricated with a square cross section from the grip means to the club head. Alternatively, it may be desirable to provide shaft means 162 with a circular cross section for portions of the shaft away from the area of slot 164.

Slot 164 may contain a transparent member 168 similar to transparent member 148' of embodiment 154 illustrated in FIGS. 21 and 22. Front planar surface 170 and rear planar surface 172 on transparent member 168 are parallel and aligned with each other.

Figure 26:
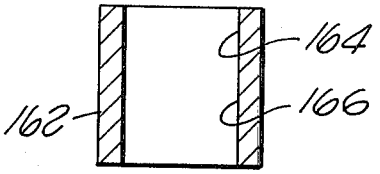
FIG. 26 is a sectional view of another embodiment similar to FIG. 25.

Alternatively, second slot 164 may be left empty as illustrated in FIG. 26.

The addition of a transparent member such as transparent member 168 of embodiment 160, transparent member 148' of embodiment 154 and transparent member 148 of embodiment 140 in their respective slots is believed to increase the overall strength of shaft means 162, shaft means 142', and shaft means 142, respectively as compared to the shafts without the transparent members. Additionally, the transparent member facilitates the positioning and durability of indicia means as described below.

Figure 27:
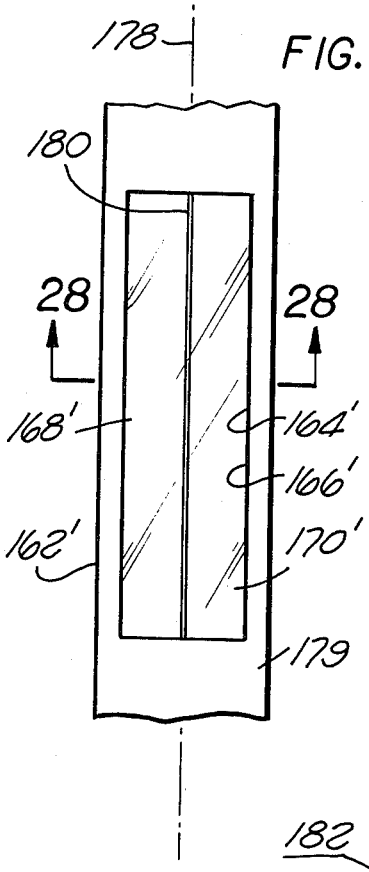
FIG. 27 illustrates another embodiment of the present invention.
Figure 28:
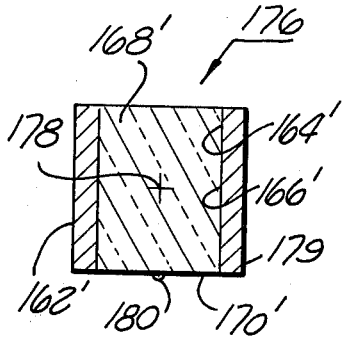
FIG. 28 is a sectional view along the line 28—28 of FIG. 27.
Figure 29:
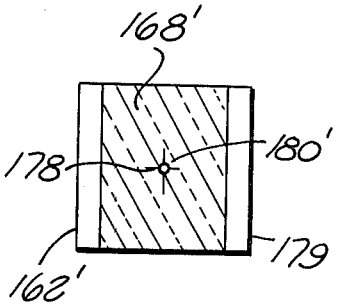
FIG. 29 is a sectional view of another embodiment similar to FIG. 28.

FIGS. 27 and 28 illustrate another embodiment, generally designated 176, of the present invention. Shaft means 162', walls 166', slot 164', and transparent member 168' are substantially identical to the respective elements in embodiment 160 illustrated in FIGS. 24 and 25. Shaft means 162' has a predetermined longitudinal axis 178 and a peripheral surface 179. Indicia means 180 lies in a plane containing longitudinal axis 178 and comprises a thin line on peripheral surface 179 at front planar surface 170' of transparent member 168'. Alternatively, as illustrated in FIG. 29, indicia means 180' shown thereon may comprise a thin wire embedded internal the transparent member 168' and coincident with the longitudinal axis 178 thereof.

It will be appreciated that any of the indicia means similar to the ones discussed above, in connection with FIGS. 1 through 20, including indicia means 56 of embodiment 40, comprising rod 58, tube 58', two thin wires 60 and 60', or a pair of lines 62 and 62'; and indicia means 116 or 116' of embodiment 110, may be utilized as indicia means in the present invention. It will be further appreciated that indicia means such as the thin wires, rods, and tube described above, may be utilized in embodiments of the present invention which do not have slots containing transparent members. However, golf clubs having slots with wire, rod, or tube indicia means, but without transparent members, must be handled more carefully to avoid physical damage to the indicia means.

Figure 30:
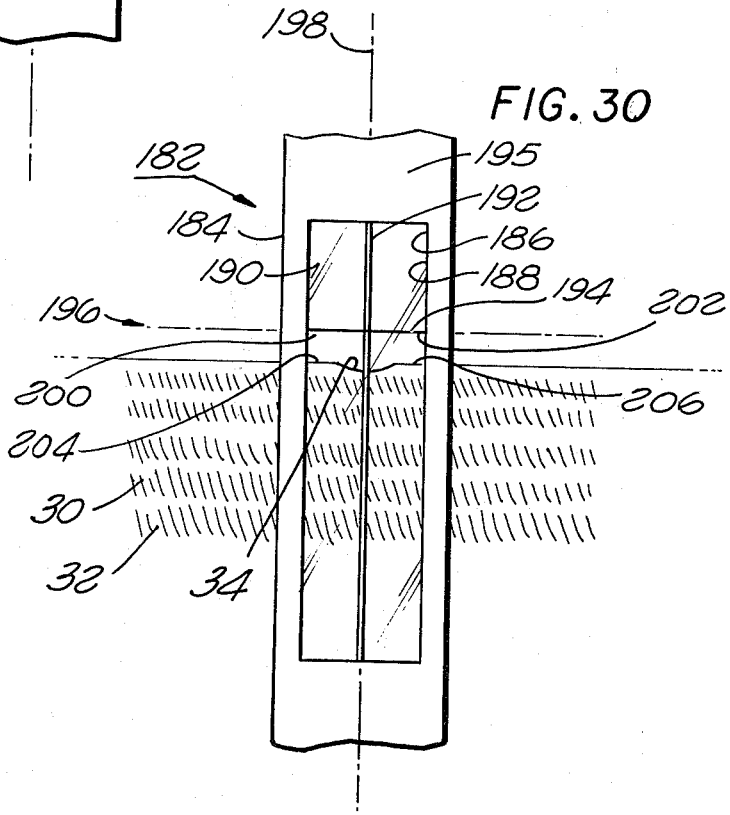
FIG. 30 illustrates another embodiment of the present invention.

FIG. 30 is another embodiment, generally designated 182, of the present invention. Shaft means 184, walls 186, slot 188, transparent member 190, and indicia means 192 are substantially identical to the corresponding parts in embodiment 176 of FIGS. 27 and 28. A cross hair indicia 194 is located at a convenient height in a plane 196 which is perpendicular to longitudinal axis 198 of shaft means 184. Cross hair 194 may be located on the peripheral surface of transparent member 190 or at any internal location in transparent member 190. Alternatively, no transparent member need be provided in slot 188 and, in such an embodiment, the indicia means 192 and cross hair 194 are provided in slot 188.

Utilization of a golf club according to the principles of the present invention, is illustrated in FIG. 30. FIG. 30 is generally similar to FIG. 4 and FIG. 10. As can be seen from FIG. 30, the green 30 in the area of the projected ball trajectory may be viewed through slot 188. Initially, as part of a two step process utilizing the embodiment of the present invention having a cross hair indicia 194 to determine the break of a green, shaft means 184 is held to position the indicia means 192 perpendicular to the plane of green 30 with the aid of cross hair 194. Generally, this result may be achieved by positioning points 200 and 202 of cross hair 194 equals distances above arbitrarily selected points 204 and 206, respectively, on green 30. Thus, shaft means 184 may be readily positioned perpendicular to the plane of green 30. The cross hair 194 thereby facilitates the positioning of shaft means 184 in a perpendicular position on those greens that are not level with the earth's surface. It is important, when utilizing this embodiment, to initially hold the shaft perpendicular in relation to the plane of the green, and not to the earth, in order to isolate from the effects of gravity on the ball, i.e., the gravitational break, the effects of the lie of the grass on the ball, i.e., the grass break.

Once shaft means 184 is located in a perpendicular position in relation to the plane of green 30, grass 32 around the cup 34 is viewed to determine the break caused by the grass. As illustrated in FIG. 30, grass 32 leans towards the left which may be readily determined by comparison of the angle of the grass to indicia means 192. The greater the angle grass 32 makes with indicia means 192, the greater will be the tendency of a golf ball putted toward cup 34 to break or move from the straight line toward the left. Therefore, the golfer may estimate from the visual appearance of the grass 32 the direction as well as the amount of the grass break.

The gravitational break is determined as a second step by suspending the club of the present invention by the grip means so that it hangs as a pendulum such that the indicia means is in true vertical with the earth. It will be appreciated that in suspending the golf club so that it hangs as a pendulum, the longitudinal axis of the shaft means may not be vertically aligned with the earth depending upon the club head weight and configuration, as well as the shaft means weight and configuration. Accordingly, if the club is to be used to determine the gravitational break, the indicia means, such as the longitudinal walls defining the slot or other indicia elements, should be positioned in the shaft means so that, for the particular golf club, they are in true vertical when so suspended. Accordingly, the indicia means may, in some embodiments, not lie in a plane containing the center line of the shaft.

Alternatively, of course, the golf club may be suspended by holding the club head with the shaft means extending downwardly. In such an application, there exists a location in the club head such that the holding of the golf club at that location causes the longitudinal axis of the shaft means to be in true vertical with the earth. The club head may be so marked at that location and, therefor, the longitudinal axis of the shaft means will be vertical when so suspended. Accordingly, the indicia means of the present invention may be aligned with the longitudinal axis of the shaft.

Once the indicia means is held in true vertical with the earth utilizing one of the above described methods, a comparison of the the plane of the green to the indicia means will allow the slope of the green to be determined. The degree and nature of the gravitational break of the green can thus be calculated. Obviously, a green having a plane that is perpendicular to the indicia means will not have any general gravitational break due to a general slope in the green. Greens that are not perpendicular to the indicia means will have general gravitational breaks of varying degree depending upon the slope away from a right angle with the indicia means. Addition or subtraction of the gravitational break to the grass break will aid in the determination of the overall break of the green.

Alternatively, a single step process may be used to determine both the grass break and gravitational break. The golf club is suspended as a pendulum, utilizing one of the methods described above, thereby positioning the indicia means in true vertical with the earth. The angle of the grass and the slope of the green are then compared to the indicia means in this position to determine both the grass break and the gravitational break in a manner similar to the manner described above.

From the above it can be seen that there has been provided an improved golf club arrangement which enables the golfer to read the green and determine the natural break thereof. Such reading of the green thus allows the golfer to estimate more accurately both the direction that the ball will travel when being putted toward the cup as well as the amount of force necessary to propel the ball toward the cup. Those skilled in the art may find many variations and adaptations of the present invention and all such variations and adaptations falling within the true scope and spirit of the invention are intended to be covered by the appended claims.

What is claimed is:

1. In a golf club, the improvement comprising, in combination:

a club head;

an elongated longitudinally extending shaft means having a first end coupled to said club head, and a second end;

a grip means coupled to said second end of said shaft means;

said shaft means having:

a predetermined longitudinal axis extending between said grip means and said club head;

a peripheral surface spaced from said longitudinal axis;

planar walls in planes parallel to each other and parallel to said longitudinal axis defining a slot extending through said shaft means for a predetermined longitudinal length intermediate said club head and said grip means and said walls at least alignable in a vertical orientation for viewing through said slot and providing visual indicia means;

a front intersection at one intersection of said walls of said slot with said peripheral surface;

a rear intersection spaced from said front intersection and at another intersection of said walls of said slot with said peripheral surface; and opaque indicia means on said shaft means and in said slot and viewable through said slot, and said opaque indicia means alignable in vertical and perpendicular orientations for viewing through said slot.

2. The arrangement defined in claim 1 wherein said indicia means is coincident with said longitudinal axis.

3. The arrangement defined in claim 1 wherein said indicia means is spaced from said longitudinal axis.

4. The arrangement defined in claim 1 wherein said peripheral surface of said shaft means is substantially cylindrical.

5. The arrangement defined in claim 1 wherein said peripheral surface of said shaft means in at least a portion of said shaft means adjacent and including said slot is substantially an equilateral quadrilateral right regular prism.

6. The arrangement defined in claim 5 wherein said equilateral quadrilateral right regular prism is right angular.

7. The arrangement defined in claim 5 and further comprising:

a transparent means substantially filling said slot;

said transparent means having:

a front planar surface on at least a portion of said transparent means adjacent said front intersection;

a rear planar surface on at least a portion of said transparent means adjacent said rear intersection; and said front planar surface parallel and aligned with said rear planar surface;

said opaque indicia means on one of said front planar surface and said rear planar surface and lying in a plane containing said longitudinal axis; and a cross hair at right angles to said opaque indicia means and on one of said front planar surface and said rear planar surface.

8. The arrangement defined in claim 1 and further comprising a cross hair extending at right angles to said opaque indicia means.

9. In a golf club, the improvement comprising, in combination a club head;

an elongated longitudinally extending shaft means having a first end coupled to said club head, and a second end;

a grip means coupled to said second end of said shaft means;

said shaft means having:

a predetermined longitudinal axis extending between said grip means and said club head;

a peripheral surface spaced from said longitudinal axis;

planar walls in planes parallel to each other and parallel to said longitudinal axis defining a slot extending through said shaft means for a predetermined longitudinal length intermediate said club head and said grip means and said walls at least alignable in a vertical orientation for viewing through said slot and providing visual indicia means;

a front intersection at one intersection of said walls of said slot with said peripheral surface;

a rear intersection spaced from said front intersection and at another intersection of said walls of said slot with said peripheral surface;

a transparent means substantially filling said slot; and said transparent means having:

a front planar surface on at least a portion of said transparent means adjacent said front intersection;

a rear planar surface on at least a portion of said transparent means adjacent said rear intersection; and said front planar surface parallel and aligned with said rear planar surface.

10. The arrangement defined in claim 9 and further comprising opaque indicia means alignable in vertical and perpendicular orientations for viewing through said slot and on at least one of said front and rear planar surfaces.

11. The arrangement defined in claim 9 wherein said peripheral surface of said shaft means is substantially cylindrical.

12. The arrangement defined in claim 11 and further comprising opaque indicia means alignable in vertical and perpendicular orientations for viewing through said slot and on at least one of said front and rear planar surfaces.

13. The arrangement defined in claim 12 and further comprising cross hair extending at right angles to said opaque indicia means.

14. The arrangement defined in claim 9 wherein said peripheral surface of said shaft means in at least a portion of said shaft means adjacent and including said slot is substantially an equilateral quadrilateral right regular prism.

15. The arrangement defined in claim 14 wherein said equilateral quadrilateral right regular prism is right angular.

16. A method for reading the break of a green due to the natural lie of the grass, which comprises:

(a) providing a golf club having a shaft means and said shaft means having walls therein defining a slot therethrough, and said slot having indicia means;

(b) positioning said shaft means in a location suitable for viewing through said slot the natural lie of the grass in the area of the projected ball trajectory;

(c) holding said shaft means to provide said indicia means perpendicular to the plane of the green;
(d) sighting the grass through said slot in the area of the projected ball trajectory to compare the angle of the lie of the grass to the said indicia means.

17. The method defined in claim 16 wherein said step of holding of said indicia means vertical to the plane of the green is achieved by utilizing a cross hair extending across said indicia means at right angles to said indicia means and equalizing the distance between a point on a first portion of the cross hair on a first side of said indicia means and a first point on the green with the distance between a point on a second portion of said cross hair on a second side of said indicia means opposite said first side of said indicia means and a second point on the green.

18. A method for reading the break of a green due to the natural lie of the grass, which comprises:
(a) providing a golf club having a shaft means and said shaft means having walls therein defining a slot therethrough, and said slot having indicia means;
(b) positioning said shaft means in a location suitable for viewing through said slot the natural lie of the grass in the area of the projected ball trajectory;
(c) holding said indicia means to a true vertical with respect to the earth;
(d) sighting the grass through the said slot in the area of the projected ball trajectory to compare the angle of the lie of the grass to said indicia means.

19. The method defined in claim 18, wherein the step of holding of said indicia means in a true vertical with respect to the earth is achieved by suspending said shaft means of said golf club to allow gravity to orient said indicia means in said true vertical with respect to the earth.

20. A method for reading the break of a green due to the natural lie of the grass and the overall slope of the green, which comprises:
(a) providing a golf club having a shaft means and said shaft means having walls therein definining a slot therethrough, and said slot having indicia means;
(b) positioning said shaft means in a location suitable for viewing through said slot the natural lie of the grass and the overall slope of the green in the area of the projected ball trajectory;
(c) holding said shaft means to provide said indicia means perpendicular to the plane of the green;
(d) sighting the grass through said slot in the area of the projected ball trajectory to compare the angle of the lie of the grass to said indicia means;
(e) holding said indicia means to a true vertical with respect to the earth; and
(f) sighting of the overall slope of the green in the area of the projected ball trajectory to compare the angle of the overall slope of the green to said indicia means.

21. The method defined in claim 2 wherein said step of holding said indicia means vertical to the plane of the green is achieved by utilizing a cross hair extending across said indicia means at right angles to said indicia means and equalizing the distance between a point on a first portion of said cross hair on a first side of said indicia means and a first point on the green with the distance between a point on a second portion of said cross hair on a second side of said indicia means opposite said first side of said indicia means and a second point on the green.

22. The method defined in claim 21 wherein said step of holding said indicia means to a true vertical is achieved by suspending said shaft means of said golf club to allow gravity to orient said indicia means to a true vertical with respect to the earth.

23. A method for reading the break of a green due to the natural lie of the grass and the overall slope of the green, which comprises:
(a) providing a golf club having a shaft means and said shaft means having walls therein defining a slot therethrough, and said slot having indicia means;
(b) positioning said shaft means in a location suitable for viewing through said slot the natural lie of the grass and the overall slope of the green in the area of the projected ball trajectory;
(c) holding said indicia means to a true vertical with respect to the earth;
(d) sighting the grass through said slot in the area of the projected ball trajectory to compare the angle of the lie of the grass to said indicia means; and
(e) sighting of the overall slope of the green through said slot in the area of the projected ball trajectory to compare the angle of the overall slope of the green to said indicia means.

24. The method defined in claim 23 wherein the step of holding said indicia means in a true vertical is achieved by suspending said shaft means of said golf club to allow gravity to orient said indicia means to said true vertical to the earth.

* * * * *